US005125201A

United States Patent [19]

Pieters et al.

[11] Patent Number: 5,125,201

[45] Date of Patent: Jun. 30, 1992

[54] JOINTS AND CONNECTOR MECHANISMS FOR WALL SYSTEMS

[75] Inventors: Frank T. Pieters, Pointe Clare, Canada; Joseph J. Smith, Palm, Pa.; Hermann Ziss, Pointe Clare, Canada

[73] Assignee: Clestra Hauserman, Inc., Cleveland, Ohio

[21] Appl. No.: 496,977

[22] Filed: Mar. 20, 1990

[51] Int. Cl.[5] ..... E04B 2/76

[52] U.S. Cl. ..... 52/238.1; 52/243.1; 52/775; 52/468

[58] Field of Search ..... 52/238.1, 243.1, 241, 52/775, 36, 468; 211/189; 312/108, 111

[56] References Cited

U.S. PATENT DOCUMENTS

| | | | |
|---|---|---|---|
| 2,394,443 | 2/1946 | Guignon, Jr. | 52/732 |
| 2,822,898 | 2/1958 | Richards | 52/468 |
| 2,962,133 | 11/1960 | Kivett et al. | 52/584 |
| 2,963,126 | 12/1960 | Cudini | 52/235 |
| 2,963,825 | 12/1960 | Douglas | 52/241 |
| 3,057,444 | 10/1962 | Walberg | 52/775 |
| 3,350,828 | 11/1967 | Russell | 52/281 |
| 3,363,383 | 1/1968 | Barge | 52/584 |
| 3,378,977 | 4/1968 | Vervloet | 52/470 |
| 3,381,436 | 5/1968 | Elliott et al. | 52/471 |
| 3,509,673 | 5/1970 | Witkosky et al. | 52/578 |
| 3,574,985 | 4/1971 | Pierce | 52/468 |
| 3,594,028 | 7/1971 | Scott | 52/471 |
| 3,685,234 | 8/1972 | Nelsson | 52/468 |
| 3,868,802 | 3/1975 | Schubach | 52/471 |
| 3,886,698 | 6/1975 | Raith et al. | 52/36 |
| 3,995,402 | 12/1976 | Parenteau | 52/586 |
| 4,251,968 | 2/1981 | Raith et al. | 52/584 |
| 4,356,672 | 11/1982 | Beckman et al. | 52/36 |
| 4,438,614 | 3/1984 | Raith et al. | 52/580 |
| 4,461,131 | 7/1984 | Pressell | 52/395 |
| 4,481,747 | 11/1984 | Tengesdal et al. | 52/460 |
| 4,689,930 | 9/1987 | Menchetti | 52/277 |
| 4,852,317 | 8/1989 | Schiavello et al. | 52/239 |

FOREIGN PATENT DOCUMENTS 1400613 7/1975 United Kingdom .

*Primary Examiner*—James L. Ridgill, Jr.
*Attorney, Agent, or Firm*—Mason, Fenwick & Lawrence

[57] ABSTRACT

Joints and connector mechanisms for use in a modular wall system which consists of a series of interchangeable panels that may be combined in various ways in order to create a business environment encompassing of a series of private offices. A joint is adapted for disposition between two sections of a movable wall for interconnecting the sections. Each section includes a panel having an elongated vertical edge defines by a pair of spaced parallel walls. The joint generally comprises two elongated vertical posts each including a mounting strip for mounting the posts to the edges of adjacent panels. A pair of spaced parallel tongues extends outwardly from the mounting strip away from the edge of the panel. First and second flexible connecting strips have first and second flange-receiving portions. In use, each of the strips is positioned between adjacent tongues of the first and second posts for receiving the tongues in each of the flange-receiving portions. The bulbous portions of each of the two fingers constituting a shank help to secure the strips to the flanges and, in this way, interconnect the adjacent panels. Also forming part of the present invention is a unique panel construction for a solid panel.

6 Claims, 6 Drawing Sheets

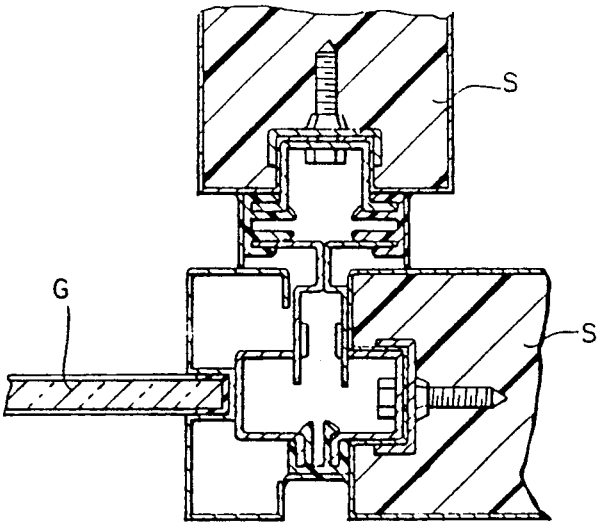
FIG. 10
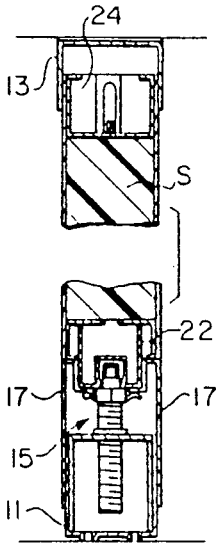
FIG. 13
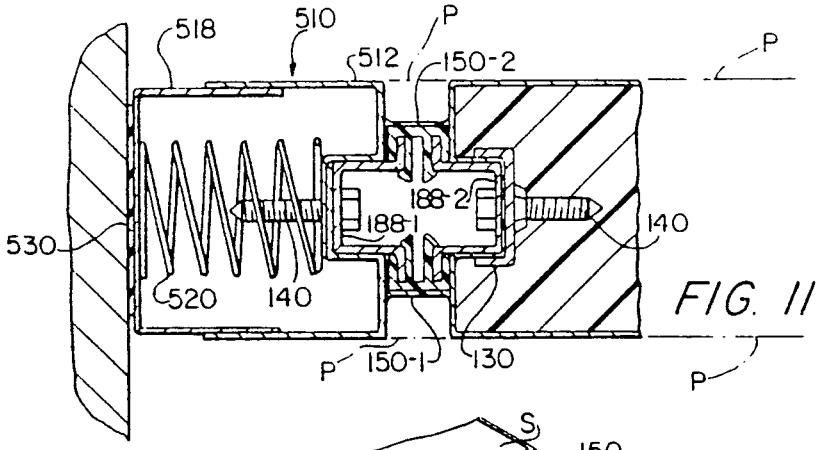
FIG. 11
FIG. 14
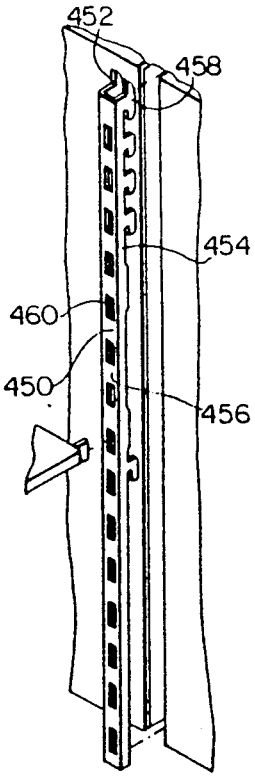
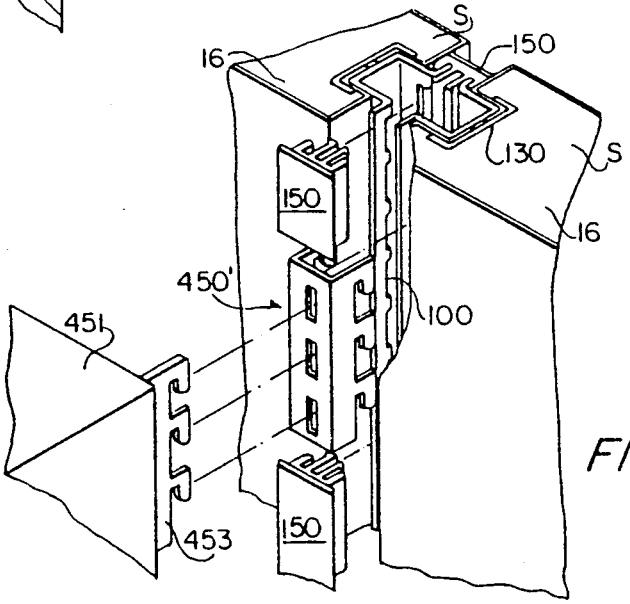
FIG. 12

JOINTS AND CONNECTOR MECHANISMS FOR WALL SYSTEMS

FIELD OF THE INVENTION

The present invention relates to modular and nonprogressive movable wall systems, in general, and to the joints and connector mechanisms used to assemble such systems, in particular.

BACKGROUND OF THE INVENTION

In today's modern business environment primary interest is placed on providing the appropriate architectural detail for a private office. At the same time, with today's cost-conscious construction, there is a desirability to also provide the flexibility of a movable wall system for convenient and economical office reconfiguration.

Prior art techniques for constructing and erecting movable wall systems have been known for many years. For example, U.S. Pat. No. 2,394,443 (Guijnon, Jr.) illustrates a system for connecting a plurality of walls to form a portable building. The system relies on pairs of T-shaped connectors which mate with each other to join end sections of adjacent walls. Other methods of joining end walls through interconnecting means are shown in U.S. Pat. Nos. 2,962,133 (Kivette et al): 3,378,977 (Vervloet); 4,852,317 (Schiavello et al); and 4,481,747 (Tengesdal).

An example of a demountable interior partition system is found in U.S. Pat. No. 4,251,968 [Raith et al (Raith)]. The Raith patent relates to an interior partition system for providing a wide variety of interior screens or full-height partitions while avoiding the necessity of the manufacturer and inventory of a large number of parts. Yet another example of a partition system that employs support capabilities is shown in U.S. Pat. No. 3,886,698 (Raith et al).

In evaluating the prior art systems, there is still a need for providing a better blending of the objectives of providing the architectural detail for a private office with the flexibility of a modular wall system. There is a desire to do this in the context of a modular nonprogressive private office system that is simple to configure and possesses great visual appeal. In this context, there is also a need to make the system panels interchangeable and reusable. The present invention is directed toward filling that need.

SUMMARY OF THE INVENTION

The present invention relates to joints and connector mechanisms for use in a modular wall system which consists of a series of interchangeable panels that may be combined in various ways in order to create a business environment encompassing of a series of private offices. In the inventive system, there are several types of wall panels available. Among the available panels are solid panels, glass panels, solid panels with a glass transom, and panels with a door assembly.

Of particular importance to the present invention are the joints and connectors used to join adjacent panels without regard to the panel construction. Thus, even though adjacent panels may be of similar or a different construction, a common ground is provided through the connector structure found on the vertical side edges of each panel in order to provide an efficient and reliable interconnection mechanism.

In a preferred embodiment of the present invention, a joint is adapted for disposition between two sections of a movable wall for interconnecting the sections. Each section includes a panel having an elongated vertical edge defined by a pair of spaced parallel walls. The joint generally comprises a first elongated vertical post including a mounting strip for mounting the post to the edge of one of the panels. A pair of spaced parallel tongues extends outwardly from the mounting strip away from the edge of the panel along substantially the full length of the post. Each of the tongues includes a flange extending outwardly from the center of the first post. The flanges occupy essentially the same plane which is parallel to the edge of the panel. A second elongated vertical post having the same construction and configuration as the first vertical post is connected to the edge of an adjacent panel.

First and second flexible connecting strips each have an elongated strip portion. A first shank outwardly extends from a surface of each strip and originates along the longitudinal axis of the strip. The first shank terminates in a head and extends along substantially the full length of each strip. A pair of edge tongues outwardly extends from the elongated edges of both of the strips. The tongue edges are essentially parallel to each other and parallel to the shank. In a preferred embodiment, the shank is made up of two spaced elongated fingers that extend throughout the full length of the strip where each of the fingers terminates in a bulbous portion.

The arrangement of the shank and the edge tongues define first and second flange-receiving portions. In use, each of the strips is positioned between adjacent tongues of the first and second posts for receiving the tongues in each of the flange-receiving portions. The bulbous portions of each of the fingers constituting a shank help to secure the strips to the flanges and, in this way, interconnect the adjacent panels.

Also forming part of the present invention is a unique panel construction for a solid panel. In a preferred embodiment, two confronting identical half-sections are provided. Each half-section is made up of a facing sheet terminating in first and second vertical side edges. Each of the side edges are turned inwardly in a direction parallel to the plane of one of the facing sheets and then turns inwardly in a direction to transverse to and away from the plane of the facing sheet. An elongated U-shaped member defines a recess channel for accommodating the inwardly turned portion of adjacent side edges of the two confronting half-sections. The length of the generally U-shaped member conforms to the length of the side edges. An elongated post is provided for mounting within the channel after the adjacent side edges have been inserted in the channel. Fasteners, such as screws, fasten the post to the U-shaped member to align and secure the side edges of adjacent panels.

A modular wall system employing the present invention progresses in three stages. First, floor and ceiling channels are put in place in the form of the desired basic layout. If there is any variation in floor level, screw leveling saddles are used within the floor channels. Next, pre-finished panels, including glass and door side panels, are erected and aligned by inserting them into the floor and ceiling channels. Third, base and vertical post covers and reveal strips are snapped into place after wiring has been completed. The doors are usually installed last after furniture has been moved into an office.

The present invention thus provides a completely modular and non-progressive movable wall system. Non-progressive indicates that panels may be removed from any location without disturbing adjoining units. A non-progressive and modular panel system has total reusability and no material loss by providing interchangeability of solid sections, glass sections and door frame assemblies on the same module.

Thus, it is a primary object of the present invention to provide private office construction incorporating the flexibility of the movable wall system for convenient and economical office reconfiguration.

It is another object of the present invention to provide a reliable and economical joint and connection system for interconnecting adjacent panels of a modular wall system.

It is yet an object of the present invention to provide a modular wall system where the system panels are interchangeable and reusable.

It is still an object of the present invention to provide a modular non-progressive private office system that is simple to configure and possesses visual appeal.

These and other objects and advantages will become apparent when the specification is read in connection with the appended drawings.

BRIEF DESCRIPTION OF THE DRAWINGS

FIG. 10 is a view taken along lines 10—10 of FIG. 1.

FIG. 11 is a view taken along lines 11—11 of FIG. 1.

FIG. 12 is a detailed view of a portion of the system illustrated in FIG. 1.

FIG. 13 is a view taken along lines 13—13 of FIG. 1.

FIG. 14 is a perspective view of a portion of the detail concerning the use of brackets in the embodiment of FIG. 1.

DETAILED DESCRIPTION OF THE PREFERRED EMBODIMENTS

Figure 1:
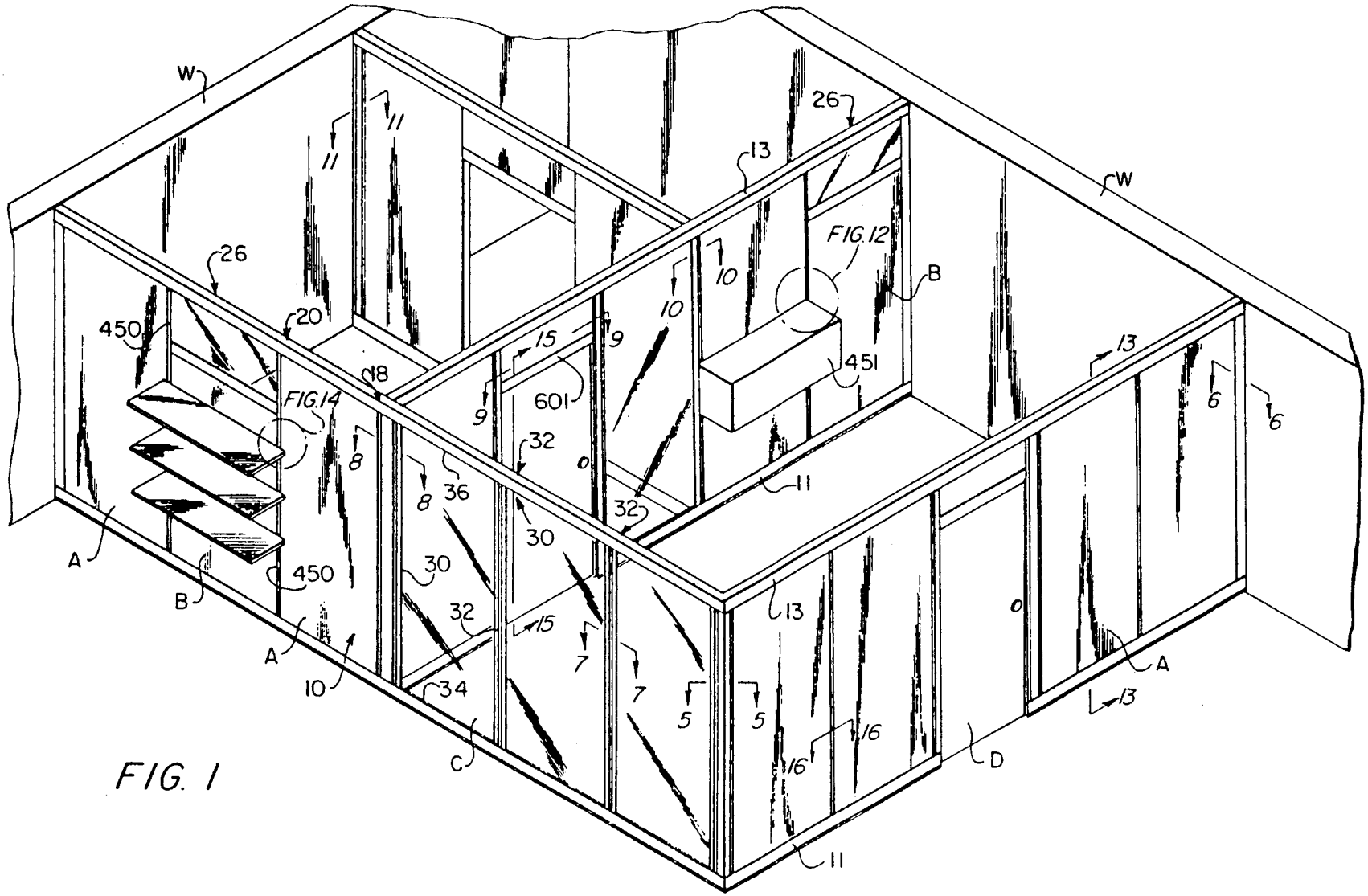
FIG. 1 is a schematic perspective view showing a movable wall system incorporating the teachings of the present invention in a typical office configuration.

In describing the preferred embodiments of the subject invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

As shown in FIG. 1, the present invention is contemplated for use in a modular wall system which consists of a series of interchangeable panels that may be combined in various ways in order to create a business environment encompassing a series of private offices, meeting rooms and other facilities.

Figure 8:
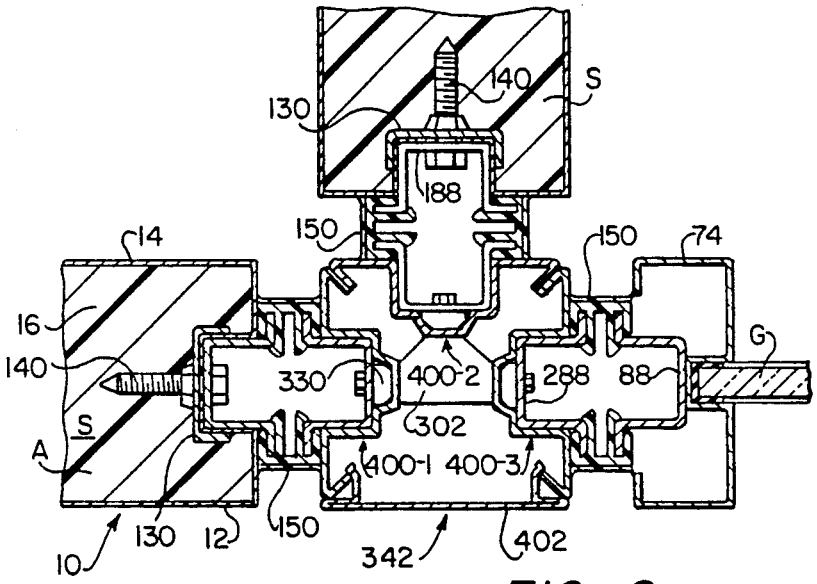
FIG. 8 is a view taken along lines 8—8 of FIG. 1.

In the inventive system, there are several types of wall panels available. As shown in FIGS. 1, 8 and 13, panel A consists of a solid panel 10 having opposed outer surfaces 12 and 14 that are spaced from each other with the space being filled by a fiberglass material 16. The opposite ends of each panel terminate in vertically oriented connector assemblies 18 and 20. These assemblies may take on different configurations as will be described hereinafter. The bottom of the panel terminates in a horizontal frame member 22, whereas the top terminates in a horizontal frame member 24.

Panel B is a solid panel including a glass transom. The solid portion of panel B is constructed in a manner similar to that of panel A. However, the solid portion of the panel is shorter than that of panel A with the remainder of the height being made up by the glass assembly 26.

Panel C is an all-glass panel and is finished by side connector portions 30 and 32, horizontal bottom frame portion 34 and horizontal top plane frame portion 36.

There is also a provision for door panels D incorporating full door assemblies, the details of which will be described hereinafter. All of the different types of panels are constructed and configured in accordance with known prior art techniques. The exception to this is the solid panel A which contains a novel structure for assembling two confronting identical half-sections 12 and 14 into a single panel. With reference to FIG. 13, in use, the panels are erected by placing them in conventional floor and ceiling channels 11 and 13. Each panel includes a conventional height adjustment mechanism 15 to ensure proper alignment of the panel within the floor and ceiling channels. Adjustments to panel height are made and then each panel receives a decorative bottom plate 17 to cover the height adjustment mechanism 15 and to complete the aesthetic look of the panel.

What follows is a description of the joints and connectors used to join adjacent panels without regard to whether the panel is solid, glass, solid with a glass transom, or a door assembly. Thus, even though adjacent panels may be of similar or a different construction, a common ground is provided through the connector structure found on the vertical side edge of each panel in order to provide an efficient and reliable interconnection mechanism. For this reason, it must be understood that the following discussion deals with end panel constructions and only describes specific connection techniques with the realization that the end panels can be connected in a myriad of ways other then as specifically described herein. For example, FIG. 10 shows two solid panels S being joined to a glass panel G. Thus, through the description of this connection, we also disclose the way in which any arrangement of glass and solid panels may be connected together. This is because each glass panel terminates at its vertical side edge in the same connection structure as a solid panel, a door panel, or a transom panel.

Figure 3:
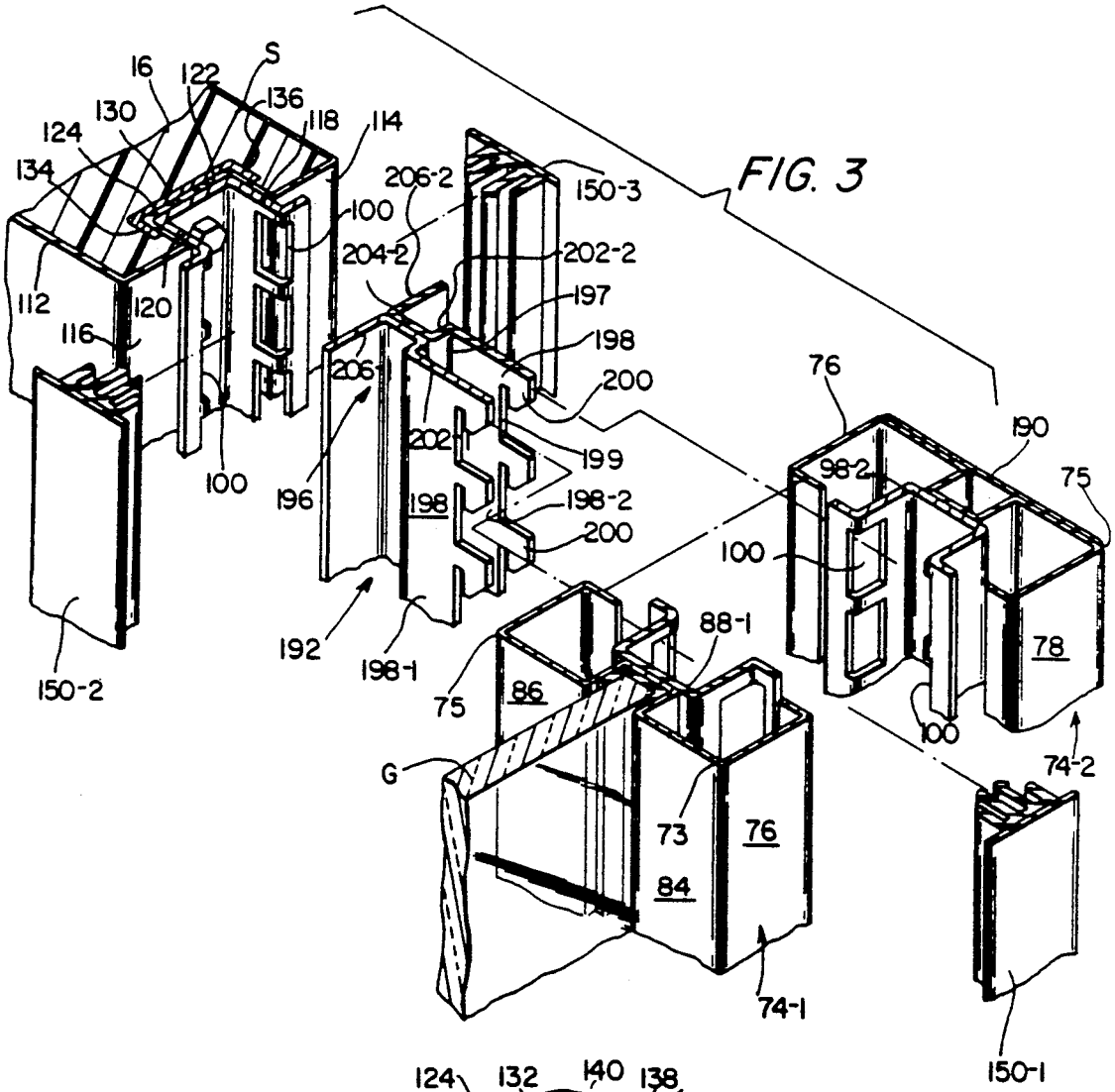
FIG. 3 is a partially exploded view of the elements found in an alternative construction for a corner connection.
Figure 7:
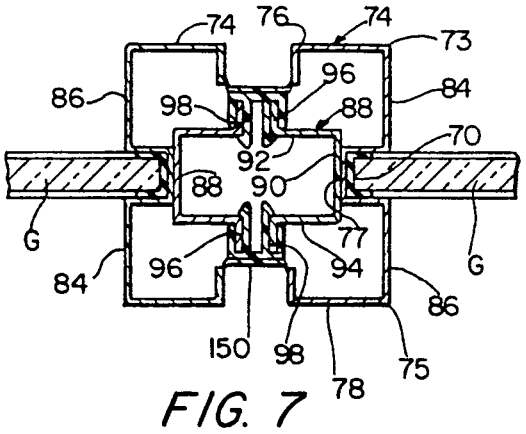
FIG. 7 is a view taken along lines 7—7 of FIG. 1.

Turning now to FIG. 7, which shows the interconnection of two glass panels, the vertical side end 70 of glass panel G is received within a channel or groove 72 defined within vertical glass panel connector member 74. As shown in FIGS. 1, 3 and 7, glass panel connector 74 comprises an elongated member formed of sheet steel and bent so that it consists of two opposed generally planar outer wall portions 76 and 78, which are spaced approximately $2\frac{1}{4}$ apart and are arranged parallel to each other. As oriented in FIG. 3, each of the wall portions 76 and 78 has a rear edge 73 and 75 that is parallel to the longitudinal axis of the connector member. Emanating from each edge in a direction toward the opposite outer wall portion are further walls 84 and 86, which are generally normal to the surfaces 76 and 78. Walls 84 and 86 move toward each other and then bend to define the channel or groove 72 for receiving and holding one end 70 of glass panel G. The most recessed portion of the channel defines a planar strip 77. Spot welded to the planar strip 77 is an inner post 88. The inner post is likewise formed of sheet steel bent to form a generally U-shaped member when an elongated strip is viewed in cross-section. The U-shaped member contains portion 90 that is spot welded to the outer surface of strip 77 of channel 72. In a preferred embodiment, the welds are approximately 6" apart throughout the lengths of both the inner post 88 and channel 72. The strip portion 90 terminates in a pair of opposed generally parallel legs 92 and 94, which radiate away from strip portion 90 and terminate in outwardly bent flange portions 96 and 98. Defined mainly in each of the legs 92 and 94, but occupying a small portion of flanges 96 and 98, are a series of spaced slots 100. The slots are defined along a vertical axis which is generally parallel to the longitudinal axis of the inner post. The slots are provided to receive hanging brackets in a manner to be described hereinafter.

Figure 4:
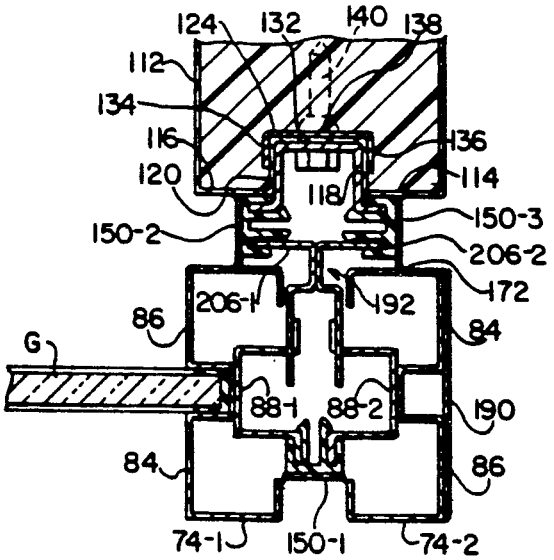
FIG. 4 is a top plan view of the corner as shown in FIG. 3.

With reference to FIGS. 3 and 4, a solid panel S consists of two planar wall sections 110 and 112 which, at their ends, include a bend to form inwardly directed wall sections 114 and 116. These walls each terminate in a bend to form further leg extensions 118 and 120 that finally terminate in inwardly directed flanges 122 and 124. As shown in FIG. 4, leg extension 118 and flange 122 form a generally L-shaped cross-section. All of the wall sections, legs and flanges discussed in the context of solid panel S extend throughout the entire vertical length of the panel. Supported on the interior surfaces of flanges 122 and 124 of each of the L members is a support channel 130. When viewed in cross-section, the support channel is generally U-shaped with an elongated middle portion 132 and two shorter leg portions 134 and 136. The generally elongated U-shaped member defines a trough or channel extending throughout the full vertical length of the panel. Portion 132 has a series of longitudinally-spaced holes 138 within which are received fasteners 140. The side connector structure of the solid panel is completed through the provision of an inner post 188 which generally has the same construction as inner post 88. The difference between the two posts is that the inner post 188 in the solid wall includes a mounting strip having a series of spaced apertures for receiving fasteners 140, whereas inner post 88 is spot welded to member 74. The apertures in the inner post 188 align with the holes 138 defined in the support channel. The holes in the support channel are unthreaded while the fasteners 140 are self-threading in order to cut screw threads in holes 138. The bent flange portions 96 and 98 are recessed from and spaced between the extended planes P defined by space parallel walls 12 and 14. The bent flange portions also occupy essentially the same plane which is parallel to the edge of the panel.

As shown in FIG. 7, two adjacent panel sections are joined together through the use of a plastic connector strip 150 that interacts with the outwardly bent flange portions 96 and 98 of the inner posts 88 of adjacent panels.

Figure 2:
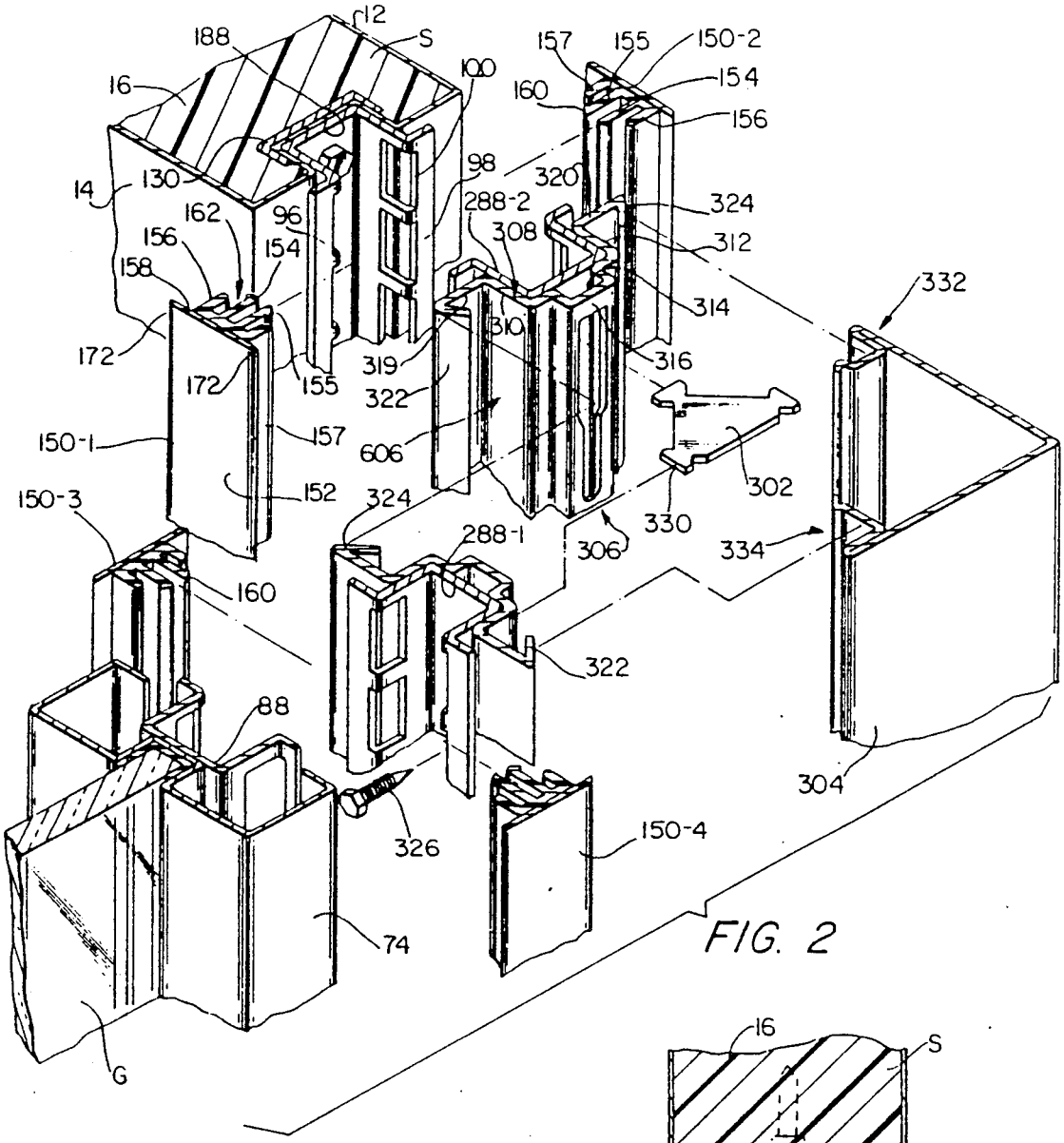
FIG. 2 is an exploded perspective view of the connecting elements found in a corner construction.

As shown in FIG. 2, elongated plastic connector strip 150 generally comprises a body portion 152 which, when viewed in cross-section, generally resembles a T formed by a series of spaced inner tongues 154 and 155, and a series of spaced outer flanges 156 and 157. All of the flanges and tongues are essentially parallel to each other and originate from an inner wall surface 158 defined by body portion 152. Each of the inner tongues 154 and 155 terminate in bulbous portions 160. Further, tongues 154 and 155 together function as a shank in a manner to be described in greater detail hereinafter.

Using tongue 155 and flange 157 as exemplary, defined between those two members is a space 162 that receives one of the flanges 98 of inner posts 88 and 188. The bulbous portion 160 of tongue 155 acts to lock flange 98 within the opening. Body portion 152 is defined by a flexible plastic layer terminating in flaps 172 at both side edges where flanges 156 and 157 originate. When connector strip 150 is positioned between adjacent panels, flaps 172 act to close off any air space between panels and, thus, reduce noise and air transfer.

FIGS. 3 and 4 show the connectors and joint structure for the connection of a solid wall S to a glass wall G at a corner. In this figure, like reference numerals are used to denote elements first discussed in connection with FIGS. 3 and 7. However, it should be noted that an additional number is used in some cases to denote how many of a particular item are employed. For example, in FIGS. 3 and 4, there are three inner posts. These have been numbered as 188, 88-1 and 88-2. This convention is used throughout when discussing additional connection arrangements.

Thus, it can be seen that the connector structure associated with the glass wall and the connector structure associated with the solid wall are the same as that previously discussed with reference with FIGS. 3 and 7. What has been added in this corner arrangement is the use of a further vertical connector member 74-2, which has been finished through the use of an elongated planar cover plate 190, that is welded to the outer wall surfaces of portions 84 and 86 of member 74-2. In addition, a corner connector 192 is used to join the solid wall to the glass wall while at the same time including finishing member 74-2 to complete the corner connection.

With reference to FIGS. 3 and 4, the corner connector 192 is made up of two generally elongated planar strips of steel that have been stamped and bent to create complimentary members 194 and 196 that are welded together. With reference to FIG. 3, and taking member 194 as exemplary, this member when viewed in cross-section generally resembles a question mark (?). The body of the question mark is defined by an elongated thin strip of material 198 that terminates at one vertical end 199 in a series of vertically displaced and horizontally extending keys 200 which mate with complimentary slots 100 defined in the inner posts 88 and 188 as described hereinbefore with reference to FIG. 3. The other vertical side 197 of the strip 198 is bent at an approximate right angle to define a small strip of material 202, the surface of which is generally perpendicular to the surface defined by strip 198. The metallic material is then bent again at the end of the vertical portion of strip 202 to create yet a wider strip 204 that is perpendicular to strip 202, essentially parallel to strip 198 and displaced a predetermined distance from the plane occupied by strip 198. Finally, the material is bent at a vertical side edge of strip 204 to define a final strip 206 that is essentially parallel to strip 202 and perpendicular to both strips 204 and 198. This completes the so-called question mark structure.

The two members 194 and 196 are joined together by welding their complimentary surfaces 204 throughout their entire length to define the corner connector 192. In use, strips 198-1 and 198-2, with their complimentary keys, are secured within the vertical slots 100 by aligning the keys to the slots, moving the corner connector toward the slots to engage the keys within the slots and then applying a downward pressure to seat the keys within the slots as shown in FIG. 4.

A plastic connector strip 150-1 is used to join the opposite sides of the inner posts 88-1 and 88-2

When the corner connector is mounted to the inner posts as just described, the end surfaces 206-1 and 206-2 define outwardly extending flanges which align with the flanges 96 and 98 defined by inner post 188. When these flanges are aligned with each other they provide a mounting means for employing the plastic connector strip 150-2 and 150-3 to join the solid wall to the resultant structure. As shown in FIG. 4, when employing the corner connector, the plastic flaps 172 associated with the connector strips 150 are relatively undistorted at the point where the connector strip meets one of the vertical connector members.

Figure 5:
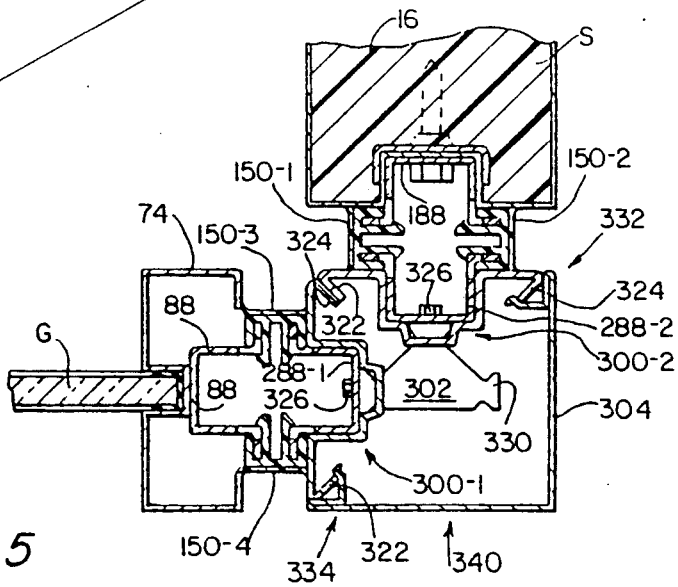
FIG. 5 is a view taken along lines 5—5 of FIG. 1.

FIGS. 2 and 5 show an alternative arrangement for a corner connection. In this alternative arrangement, a corner post 340 is constructed from several different pieces. Essentially, the corner post consists of two post assemblies 300-1 and 300-2, central locking members 302 and a corner cover plate 304.

As shown in FIG. 2, and taking post 300-1 as exemplary, the post assembly consists of a regular post 306 and an inner post 288. Inner post 288 is of the same construction and formation as inner post 88 used in conjunction with a solid wall.

Regular post 306 is made of an aluminum extrusion shaped to define the structure of the regular post. Essentially, the post includes an elongated trough or channel 308 defined by a pair of opposed side walls 310 and 312. At the ends of the side walls near the recess of the channel, the base of the channel bends inward to define yet another recess or smaller channel 314. The base of this channel defines the base surface 316 of the regular post. At the distal ends of side walls 310 and 312, outwardly extending flange portions 318 and 320 terminate in further folded portions 322 and 324 which are bent so that they point toward the base of the channel 308. Channel 308 is sized to receive inner post 288. Screws or fasteners 326 occupy apertures defined in the inner post and tap into complimentary apertures defined in the bottom surface 316 of the regular post.

The base wall 316 of the regular post also includes a plurality of elongated keyholes that are evenly spaced throughout the entire length of the regular post. These keyholes mate with key ends 330 defined on key members 302. Several keyholes with key members are spaced on the average about 10" to 12" apart and ensure the structural integrity of the resulting post.

Returning to FIGS. 2 and 5, adjacent ends of surfaces 322 and 324 are placed in intimate contact with each other to align the two post assemblies 300-1 and 300-2 at generally right angles to each other. The structure is completed through the use of a decorative cover plate 304 which contains biased end arms 332 and 334, which grasp the fingers 322 and 324 of the regular post assemblies 300-1 and 300-2. In this way, a corner post 340 is provided which, when viewed in cross-section, generally resembles a square with two adjacent sides of the square defining connection points for two walls. The inner post 288-2 is joined to inner post 188 of solid wall S in the same manner as described with reference to FIG. 7 through the use of flexible connector strips 150-1 and 150-2. The same may be said with regard to the joining of inner posts 288-3 of solid wall S and 288-4 of corner post 340.

FIG. 8 shows yet another embodiment where three walls are joined to a central post 342. The connector structures associated with each of the walls which, in the example of FIG. 8 are two solid walls and one glass wall, are the same as that previously discussed and, therefore, have like reference numerals to denote like elements. Likewise, the construction of each of the three regular post assemblies 400-1, 400-2 and 400-3 is the same as the construction of those previously described assemblies 300-1 and 300-2 of FIG. 5. In the embodiment of FIG. 8, a shorter cover plate 402 is used to finish off the post assembly 342.

Figure 16:
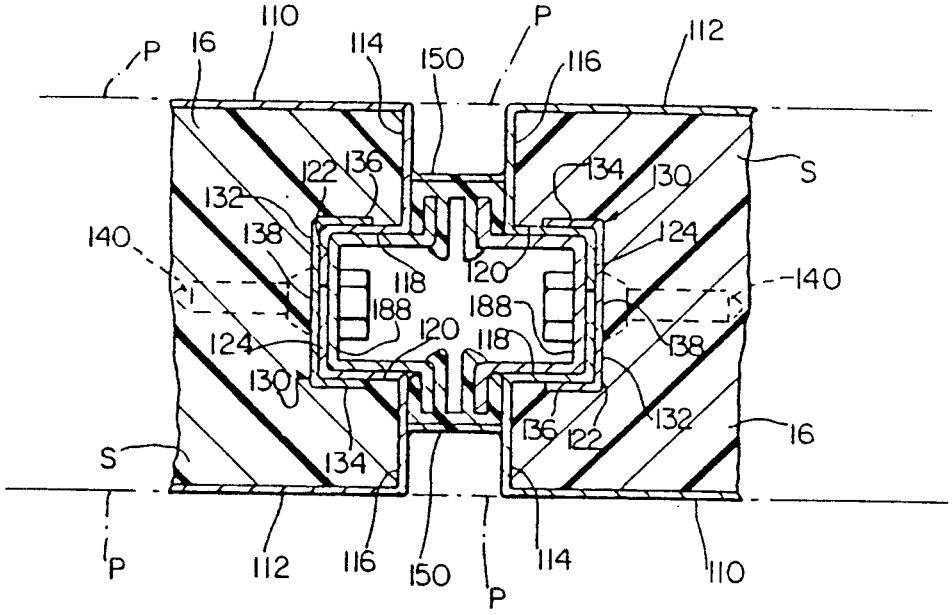
FIG. 16 is a view taken along lines 16—16 of FIG. 1.

FIG. 16 shows a connection joint for two solid walls S. The reference numerals used in FIG. 16 are the same as the numerals used in FIGS. 3 and 4 with regard to the portion of the joint associated with the solid walls. The joint associated flange portion of said second post in the second flange-receiving portion to interconnect the adjacent panels.

The present connection system also uses suspended cabinets and the like complemented by the use of brackets for supporting shelving. In this regard, as shown in FIGS. 1 and 14, a hanging bracket 450 consists of a generally elongated U-shaped member that defines a channel. The member consists of two side portions 452 and 454 that are joined together by a cross member 456. The vertical edges of the side portions terminate in teeth or keys 458 which mate with the vertical slots 100 defined in the inner posts. The cross piece 456 also includes a plurality of vertical slots 460 throughout the entire length of the hanging bracket. These slots are sized to accommodate conventional bracket systems, such a that currently used by Knoll International and referred to as the Morrison System.

In an alternative hanging arrangement, as shown in FIG. 12, the same bracket 450 may be used to accommodate fixtures, such as cabinet 451, which has a short mounting member 453. The plastic connecting strip can be shortened as by cutting to accommodate the space required by bracket 450. In this way, the desired aesthetic look of a single reveal is preserved.

Figure 6:
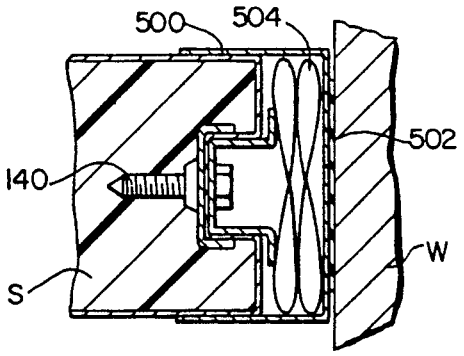
FIG. 6 is a view taken along lines 6—6 of FIG. 1.

The present inventive connection system also contemplates a number of ways to accommodate the relationship between an existing building wall and the walls added by the inventive system. In FIG. 6, a solid wall S meets a permanent wall W. In order to accomplish this, a cover shell 500 mates in slidable arrangement with the end of solid wall S. The outer surface of cover 500 that mates with wall W is covered by a resilient member 502 which acts as a seal. The resilient member 502 is preferably made from a closed cell material, such as neoprene. Positioned throughout the vertical height of the cover member is a resilient packing material 504 which act to urge the cover away from the solid wall S and toward the wall surface W.

In an alternative arrangement, where the solid wall S ends a larger distance away from wall W, an extension assembly 510 is provided. With reference to FIG. 11, this assembly is made up of two elongated pre-formed members 512 and 514 which are joined together and fastened on inner post 188-1 through the use of fasteners 140. This defines an open structure which slid ably receives a cover member 518. Positioned about 2' from both the top and bottom of the extension assembly are a pair of compression springs 520 which urge the cover away from the solid wall S toward the wall W. A resilient seal 530 is also provided.

Figure 15:
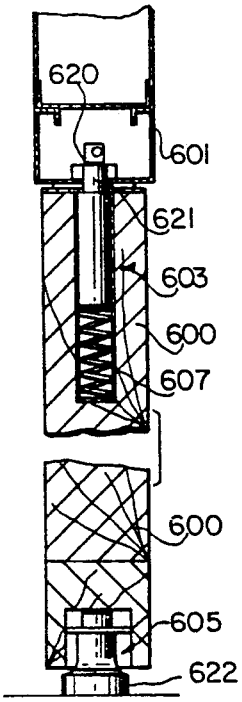
FIG. 15 is a view taken along lines 15—15 of FIG. 1.
Figure 9:
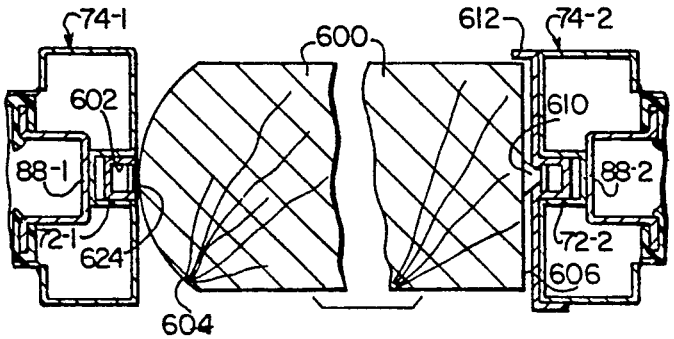
FIG. 9 is top plan view partially cut away of a doorway as viewed along lines 9—9 of FIG. 1.

FIGS. 1, 9 and 15 illustrate the way in which a door is secured to a door panel. Door 600 is secured to a horizontal transom 601 through the use of a top pivot assembly 603 and a bottom pivot assembly 605. The top pivot consists of a pivot pin 621 that is pivotally received in a hole 620 defined in transom 601. The pin is biased in the direction of hole 620 by a compression spring 607. In order to permit the door to swing in an unobstructed manner, the side edge 604 of the door is curved.

The other side edge 606 is straight and brushes up against a weather striping 610 that is positioned within recess 72-2. A similar weather striping 624 is positioned within recess 72-1 of member 74-1. A door stop plate 612 is secured to vertical member 74-2 and limits the advancement of door 600.

Members 74-1 and 74-2 have the same detail and construction as the member associated with a glass panel and, thus, have the same reference numerals for like elements.

From the above, it is apparent that many modifications and variations of the present invention are possible in light of the above teachings. For example, the plastic strip 150 may be substituted by a metallic strip made of, for example, stainless steel, and employing the mounting structure previously discussed in connection with bracket 450. It is therefore to be understood that, within the scope of the appended claims, the invention may be practiced otherwise than as specifically described.

What is claimed is:

1. A joint adapted for disposition between two sections of a movable wall for interconnecting the sections, each section including a panel having a pair of elongated vertical edges defined by a pair of spaced parallel walls, each of the vertical edges includes a longitudinally extending recessed channel, said joint comprising:

a first elongated vertical post including a mounting strip shaped for mounting said post within the recessed channel of one of said panels, a pair of spaced parallel legs extending outwardly from said mounting strip away from the channel of said panel along substantially the full length of said post, each of said legs including a bend for defining a first flange extending outwardly from the center of said first post, said first flanges being recessed from and spaced between the extended planes defined by said spaced parallel walls, and occupying essentially the same plane which is parallel to the edge of said panel;

a second elongated vertical post including a mounting strip shaped for mounting said post within the recessed channel of the other of said panels, a pair of spaced parallel legs extending outwardly from said mounting strip away from the channel of said other panel along substantially the full length of said second post, each of said legs including a bend for defining a second flange extending outwardly from the center of said second post, said second flanges being recessed from and spaced between the extended planes defined by said spaced parallel walls, and occupying essentially the same plane which is parallel to the edge of said panel;

a first flexible connecting strip having an elongated planar strip portion, a first tongue outwardly extending from a surface of said strip and originating along the longitudinal axis of said strip, said first tongue terminating in a head and extending along substantially the full length of said first strip, and a pair of outer flanges outwardly extending from the elongated edges of said first strip, said outer flanges being parallel to each other and parallel to said tongue; and the arrangement of said tongue and said outer flanges defining first and second flange-receiving portions, said first strip being positioned between adjacent flange portions of said first and second posts for receiving said flange portions of said first post in the first flange-receiving portion and for receiving the flange portion of said second post in the second flange-receiving portion to interconnect the adjacent panels.

2. The joint of claim 1, further comprising:

a plurality of first slots defined along the full length of said vertical post along the area where said tongues bend to define said first flanges;

a plurality of second slots defined along the full length of said vertical post along the area where said tongue bends to define said second flanges;

a rigid first connecting strip having an elongated strip portion, and a pair of edge tongues outwardly extending from the elongated edges of said first strip, said edge tongues being parallel to each other; and a plurality of key members emanating from the edge of each of said edge tongues, said key members positioned to mate and be aligned with said first and second sets of slots to interconnect the adjacent panels.

3. A joint adapted for disposition between two sections of a movable wall for interconnecting the sections, each section including a panel having elongated vertical edges defined by a pair of spaced parallel walls, said joint comprising:

a first elongated vertical post including a mounting strip for mounting said post to the edge of one of said panels, a pair of spaced parallel legs extending outwardly from said mounting strip away from the edge of said panel along substantially the full length of said post, each of said legs including a bend for defining a first flange extending outwardly from the center of said first post, said first flanges occupying essentially the same plane which is parallel to the edge of said panel;

a second elongated vertical post including a mounting strip for mounting said post to the edge of the other of said panels, a pair of spaced parallel legs extending outwardly from said mounting strip away from the edge of said other panel along substantially the full length of said second post, each of said legs including a bend for defining a second flange extending outwardly from the center of said second post, said second flanges occupying essentially the same plane which is parallel to the edge of said panel;

a plurality of first slots defined along the full length of said vertical post along the area where said legs bend to define said first flanges;

a plurality of second slots defined along the full length of said vertical post along the area where said legs bend to define said second flanges;

a rigid first connecting strip having an elongated strip portion, and a pair of edge tongues outwardly extending from the elongated edges of said first strip, said edges tongues being parallel to each other; and a plurality of key members emanating from the edge of each of said edge tongues, said key members positioned to mate and be aligned with said first and second sets of slots to interconnect the adjacent panels.

4. A panel unit comprising:

two confronting identical half sections, each half section comprising a facing sheet terminating in first and second vertical side edges;

each of said first and second side edges turned inwardly in a direction parallel to the plane of said facing sheet and then turning inwardly in a direction transverse to the plane of said facing sheet and away from said facing sheet;

an elongated generally U-shaped member defining a recessed channel for accommodating the inwardly turned portions of adjacent side edges of said two confronting half sections, the length of said member generally conforming to the length of said side edges;

an elongated post means for mounting within said channel after said adjacent side edges have been inserted in said channel; and fastening means for fastening said post means to said U-shaped member to align and secure said side edges of said adjacent panel.

5. The panel unit of claim 4, wherein said fastening means comprises a plurality of self-threading screws and said U-shaped member includes a plurality of spaced holes for receiving said screws.

6. The panel unit of claim 4, wherein each half section is fabricated from steel.

* * * * *